US005410901A

United States Patent [19]

Robblee et al.

[11] Patent Number: 5,410,901

[45] Date of Patent: May 2, 1995

[54] METHOD AND APPARATUS FOR FORMING OVERLAPPED TAPE

[75] Inventors: John J. Robblee, Raleigh, N.C.; William D. Bohannon, Jr., Lawrenceville, Ga.; Kevin C. Ewing, Hickory, N.C.

[73] Assignee: Sumitomo Electric Lightwave Corp., Research Triangle Park, N.C.

[21] Appl. No.: 103,192

[22] Filed: Aug. 6, 1993

[51] Int. Cl.[6] ..... B21D 39/02; B21D 49/00; H01B 13/22

[52] U.S. Cl. ..... 72/176; 72/52; 29/728; 29/828; 156/54

[58] Field of Search ..... 72/52, 48, 176, 282; 29/828, 728; 156/54, 53

[56] References Cited

U.S. PATENT DOCUMENTS

| | | | |
|---|---|---|---|
| 715,570 | 12/1902 | Friel | 29/728 |
| 1,034,954 | 8/1912 | Beebe | 72/176 |
| 2,090,744 | 8/1937 | Boe | 72/176 |
| 2,097,501 | 11/1937 | Reichelt | 173/264 |
| 2,234,523 | 3/1941 | Fischer et al. | 173/244 |
| 2,285,263 | 6/1942 | Fitch | 93/82 |
| 2,373,531 | 4/1945 | Bertalan | 72/52 |
| 2,700,408 | 1/1955 | Babbitt | 153/49 |
| 3,087,007 | 4/1963 | Jachimowicz | 174/110 |
| 3,433,043 | 3/1969 | Vermeulen et al. | 72/176 |
| 3,816,643 | 6/1974 | Pechhold | 174/107 |
| 3,826,862 | 7/1974 | Ichiba et al. | 174/102 |
| 3,843,568 | 10/1974 | Woodland et al. | 260/2.5 |
| 3,847,010 | 11/1974 | Zuber | 72/468 |
| 3,869,902 | 3/1975 | Iyengar et al. | 72/52 |
| 3,918,283 | 11/1975 | Kosch et al. | 72/52 |
| 3,932,215 | 1/1976 | Kruger | 176/36 |
| 4,025,375 | 5/1977 | Leasure | 156/79 |
| 4,035,211 | 7/1977 | Bill et al. | 156/54 |
| 4,049,904 | 9/1977 | Hori et al. | 174/107 |
| 4,100,003 | 7/1978 | Trusch | 156/54 |
| 4,151,365 | 4/1979 | Hacker | 174/107 |
| 4,308,662 | 1/1982 | Bohannon, Jr. | 29/828 |
| 4,319,473 | 3/1982 | Franke, Jr. et al. | 72/196 |
| 4,482,413 | 11/1984 | Bohannon, Jr. et al. | 156/54 |
| 4,563,540 | 1/1986 | Bohannon, Jr. et al. | 174/23 |
| 4,569,704 | 2/1986 | Bohannon, Jr. et al. | 156/48 |
| 4,595,431 | 6/1986 | Bohannon, Jr. et al. | 156/54 |
| 4,622,092 | 11/1986 | Bohannon, Jr. et al. | 156/461 |
| 4,753,002 | 6/1988 | Chabene | 29/728 |
| 4,763,983 | 8/1988 | Keith | 350/96.23 |
| 5,018,268 | 5/1991 | Chabane | 72/52 |
| 5,043,037 | 8/1991 | Buckland | 156/166 |
| 5,165,003 | 11/1992 | Carter | 385/112 |

FOREIGN PATENT DOCUMENTS 137026 12/1902 Germany .

*Primary Examiner*—Daniel C. Crane
*Attorney, Agent, or Firm*—Richard E. Jenkins

[57] ABSTRACT

Provided is a method and apparatus employing stepped overlap apertures disposed in adjacent overlap rings. The rings are arranged so that the diameters of the stepped apertures are sequentially decreasing. The apertures form a generally flat advancing metal tape into a cylindrical tube having overlapped edges. Typically, the cylindrical tube is used as a metal guard about a cable core. Each aperture is generally circular but one quadrant of the circle contains a step whereby the diameter of the aperture increases. The final tubular configuration of generally circular cross-section of the metal tape about the cable core is developed in the final smaller diameter overlap rings which bring together the two overlapped metal edges of the metal tape. Then, the metal tape passes to finishing rings which press the two engaged overlapped edges so that these edges now stay together as a longitudinal overlapped seam.

17 Claims, 3 Drawing Sheets

METHOD AND APPARATUS FOR FORMING OVERLAPPED TAPE

TECHNICAL FIELD

The present invention relates to a method and apparatus for forming a long metallic tape into a cylindrical tube as a guard about a cable core. The cylindrical tube is formed by advancing the metallic tape longitudinally through a die as the tape bends transversely, and joining the two longitudinal edges of the metallic tape to form an overlapped seam. More particularly, the invention relates to a method and apparatus for placing a protective metallic cylindrical tube about a small diameter cable core.

DESCRIPTION OF THE PRIOR ART

Cable cores enclosed within a metal sheath or guard are commonly used as communications cables. The cable core may be one conductor, such as an electrical insulated conductor or an optical conductor, but typically a plurality of conductors are used for the cable core. Also, commonly used as the metal for the sheath is aluminum, steel, or both an aluminum sheath and a steel sheath are used. The aluminum protects the cable core from lightning damage in the field, whereas the steel provides mechanical protection as well as a degree of hardness so that rodents cannot chew through the cable. The steel is typically the outside sheath and the aluminum is typically the inside sheath, when two sheaths are used.

The sheaths or guards are formed from long tapes of metal which are wrapped longitudinally about the cable core so that one longitudinal edge of the metal overlaps with the other longitudinal edge of the metal, thereby forming an overlapped seam. Usually, the metal is corrugated to make the finished product flexible so it will bend easily in use, although corrugations are not necessary for forming an overlapped seam. The result is that the metal is formed into a cylindrical tube that acts as a guard to protect the cable core. Also in the commercial embodiment of such metal-guarded cable cores, the metal outside is typically coated with a layer or layers of extruded plastic. The plastic helps protect the metal from exposure to moisture, oxygen, and the like, in the environment, and thus helps prevent corrosion of the metal.

Thirty years ago or so, the overlapped edge portions of the seam were commonly joined by soldering or by an adhesive. More recently in the last decade or so, however, the edges have been joined to make the seam by suitable forming or working of the metal tape, in essence forming a lock seam.

One patent in the area of forming a metallic tape into a tube having an overlapped seam is U.S. Pat. No. 4,308,662 to Bohannon. This patent relates to the formation of a substantially circular metallic shield about a cable core by wrapping a metallic tape longitudinally about the core with longitudinal edge portions of the tape being overlapped by a forming key to provide a closed seam in the metallic tape.

The key in U.S. Pat. No. 4,308,662 has two guideways whereby one portion of the key is disposed outside the metal and the other portion of the key is disposed between the metal and the cable core as the key overlaps and engages the two longitudinal edges of the metal together to form a shield or guard about the cable core. To prepare the metal for the seam forming by the key, the long tape of metal is first passed through a cone initially to break it, i.e. start shaping it into a U-shape instead of a flat shape so it can eventually be made into a circular shape. Inside the cone is a cylindrically shaped core tube to assist the metal as it breaks so that it bends towards a U-shape and then eventually towards a circular shape about the cable core. In other words, the metal is disposed between the cone and the core tube.

After passing the metal through the cone, the next step in U.S. Pat. No. 4,308,662 is to pass the metal through a plurality of concentric annular rings of sequentially decreasing diameter, called cone rings, further to conform the metal into a circular configuration. It is after the metal passes out of the cone rings that the metal goes into the key for the final step of forming the seam. The disclosure of U.S. Pat. No. 4,308,662 is hereby incorporated by reference.

Also of background interest are U.S. Pat. No. 3,869,902 to Iyengar et al. and U.S. Pat. No. 3,847,010 to Zuber. Each of these patents discloses a method and apparatus for forming a tubular sheet about a cable core from a continuous metal tape. The apparatus includes four sections. The first section has a tubular mandrel located above a forming trough. The second section has a forming ring located at the end of the forming trough which receives the end of the mandrel. The third section has an overlapping die assembly spaced apart from the forming ring. The fourth section has a sizing or finishing die assembly spaced apart from the overlapping die assembly. Of note is that the overlapping die assembly has compression spring 72, which via handles and pins, bears on the conical inner surface of ring 63 to adjust the depth of step 65 thereof.

Also of background interest is U.S. Pat. No. 3,433,043 to Vermeulen et al., which discloses a die for forming a tubular element from a flat metal strip. The die defines a forming channel that is a shaping funnel for the metal strip to bend it gradually about a cable. At column 2, lines 45–52 of the patent is described an inwardly extending pressure member that is used near the end of the shaping funnel in order to make the longitudinal edges of the metal strip overlap. Alternatively, the same effect can be obtained by adjusting the funnel asymmetrically.

Lastly of background interest is U.S. Pat. No. 3,918,283 to Kosch et al. This patent discloses a method for forming metal tape into a tubular form by processing the tape through a plurality of complementary-shaped pairs of rollers which progressively change the shape of the tape from flat to a generally circular cross-section with a lock seam joining the edges thereof.

DISCLOSURE OF THE INVENTION

In accordance with the present invention, applicants provide a method of forming a metallic tape into a substantially cylindrical configuration having a longitudinal overlapped seam. The method comprises moving successive increments of a generally flat metallic tape into engagement with a breaking means, which causes the successive increments to have at least a partially curved configuration. The metallic tape has two longitudinal edges whereby via the curved configuration the longitudinal edges of the successive increments approach becoming adjacent each other.

Then, the partially curved successive increments move through a plurality of adjacent forming apertures. The adjacent forming apertures are of a generally circular cross-section and have sequentially decreasing diameters, which causes the metallic tape to have a generally U-shaped configuration and then a generally C-shaped configuration that is approaching a generally circular configuration as the two longitudinal edges become increasingly adjacent each other.

Then, the successive increments move through a guider aperture. The guider aperture is of generally circular cross-section having a U-shaped notch in one quadrant thereof, said U-shaped notch having a first side and a second side, whereby one longitudinal edge of the metallic tape engages the first side of the U-shaped notch and the other longitudinal edge of the metallic tape engages the second side of the U-shaped notch, thereby maintaining the metallic tape in alignment.

The successive increments of the aligned metallic tape then move through a plurality of adjacent overlap apertures. The overlap apertures are of sequentially decreasing diameter. Each of said overlap apertures is of a generally circular cross-section having a step in one quadrant thereof, whereby the diameter of each overlap aperture increases in that quadrant so that one longitudinal edge of the metallic tape engages the step. Thus, as the successive increments of the metallic tape pass through the overlap apertures, the longitudinal edge of the metallic tape in engagement with the step becomes an overlapping longitudinal edge which overlaps the other underlapping longitudinal edge of the metallic tape, whereby the overlapping longitudinal edge is directed into substantially continuous engagement with the underlapping longitudinal edge to cause the metallic tape to be a generally cylindrical tube of generally circular cross-section.

Then, the successive increments of the cylindrical tube move through two adjacent finish apertures which are of generally circular cross-section and of sequentially decreasing diameter. The finish apertures depress the overlapped edge onto the underlapped edge to maintain the engagement thereof as a longitudinal overlapped seam.

Also, in accordance with the present invention, applicants provide an apparatus for forming a generally flat metallic tape into a substantially cylindrical configuration having a longitudinal overlapped seam. The apparatus comprises a breaking means, a plurality of adjacent forming apertures, a guider aperture, a plurality of adjacent overlap apertures, and finish apertures.

The breaking means will, when engaged with moving successive increments of a generally flat metallic tape, cause the successive increments to have at least a partially curved configuration. The metallic tape has two longitudinal edges whereby via the curved configuration the longitudinal edges of the successive increments approach becoming adjacent each other.

The plurality of adjacent forming apertures are of a generally circular cross-section and have sequentially decreasing diameters. These forming apertures will, when the successive increments having the at least partially curved configuration are moved therethrough, cause the metallic tape to have a generally U-shaped configuration and then a generally C-shaped configuration that is approaching a generally circular configuration as the two longitudinal edges become increasingly adjacent each other.

The guider aperture is of generally circular cross-section and has a U-shaped notch in one quadrant thereof. The U-shaped notch has a first side and a second side. The guider aperture will, when the successive increments are moved therethrough, engage one longitudinal edge of the metallic tape with the first side of the U-shaped notch and the other longitudinal edge of the metallic tape with the second side of the U-shaped notch, thereby maintaining the metallic tape in alignment.

The plurality of adjacent overlap apertures are of sequentially decreasing diameter. Each of said overlap apertures is of a generally circular cross-section having a step in one quadrant thereof, whereby the diameter of each overlap aperture increases in that quadrant. The overlap apertures will, when the successive increments of the metallic tape pass therethrough, engage one longitudinal edge of the metallic tape with the steps of the apertures. As a result, the one longitudinal edge becomes an overlapping longitudinal edge which overlaps the other underlapping longitudinal edge of the metallic tape, whereby the overlapping longitudinal edge is directed into substantially continuous engagement with the underlapping longitudinal edge to cause the metallic tape to be a generally cylindrical tube of generally circular cross-section.

There are at least two adjacent finish apertures. They are of generally circular cross-section and of sequentially decreasing diameter. The finish apertures will, when successive increments of the cylindrical tube pass therethrough, force or depress the overlapping edge onto the underlapping edge to maintain the engagement thereof as a longitudinal overlapped seam.

Thus, it is a feature of the present invention that the overlap and finish rings perform outside the metal so that no key or other overlap forming structure intrudes into the cavity between the metal and the cable core in order to form the overlap and depress the underlapped edge. Intrusion by a key prevents or interferes with wrapping metal tape about very small diameter cable core. Such a key is disclosed in the method and apparatus of the above-mentioned U.S. Pat. No. 4,308,662 and is a drawback thereof.

It is therefore the object of the present invention to provide a method and an overlap die capable of overlapping metal tape around relatively small diameter cable in a simple and reliable manner outside the metal without intruding into the cavity between the metal and the cable core.

Also, it is another feature of the present invention that none of the overlap rings is conical so that a spring is unnecessary therefor. Such a spring is disclosed in the apparatuses of the above-mentioned U.S. Pat. No. 3,869,902 and U.S. Pat. No. 3,847,010 and is a drawback thereof.

It is therefore another object of the present invention to provide a method and an overlap die wherein there are no springs in the overlap rings thereof, which springs can easily break and increase the maintenance costs for the die.

An advantage of the present invention is that the step of the aperture in each overlap ring minimizes friction with the metal tape as compared to the key of the prior art when forming the overlap.

Thus, another object of the present invention is to provide a method and apparatus that minimizes friction so that the apparatus lasts longer than the prior art apparatus.

Some of the objects, features, advantages, and the like of the invention having been stated above, other objects will become evident as the description proceeds, when taken in connection with the accompanying drawings as best described below.

BEST MODE FOR CARRYING OUT THE INVENTION

Figure 1:
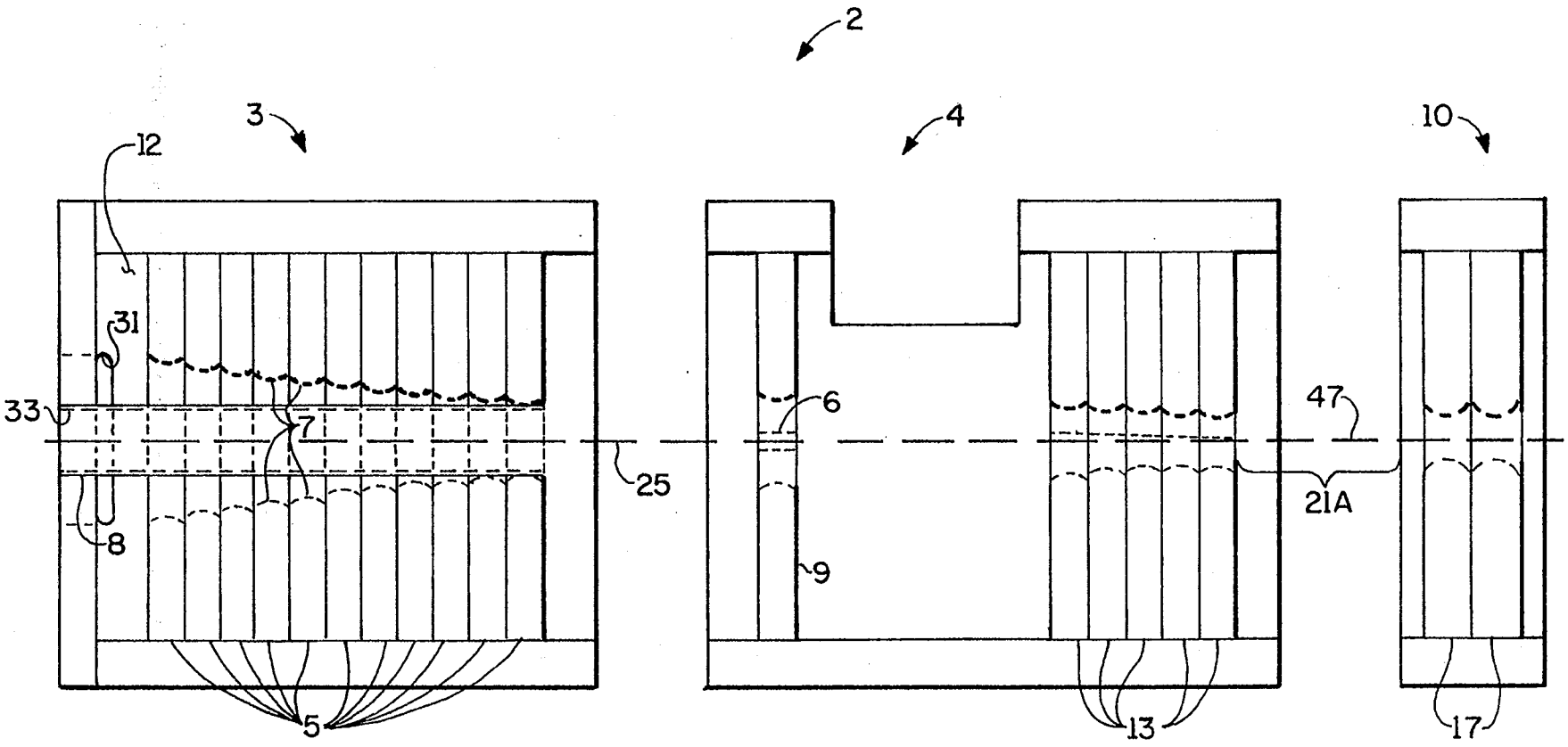
FIG. 1 is a cross-sectional side view of the apparatus in accordance with this invention, showing the three sections thereof, namely the cone former section, the overlap section, and the finish section.

The same numerals are used in the drawings to denote the same parts of the apparatus.

Figure 2:
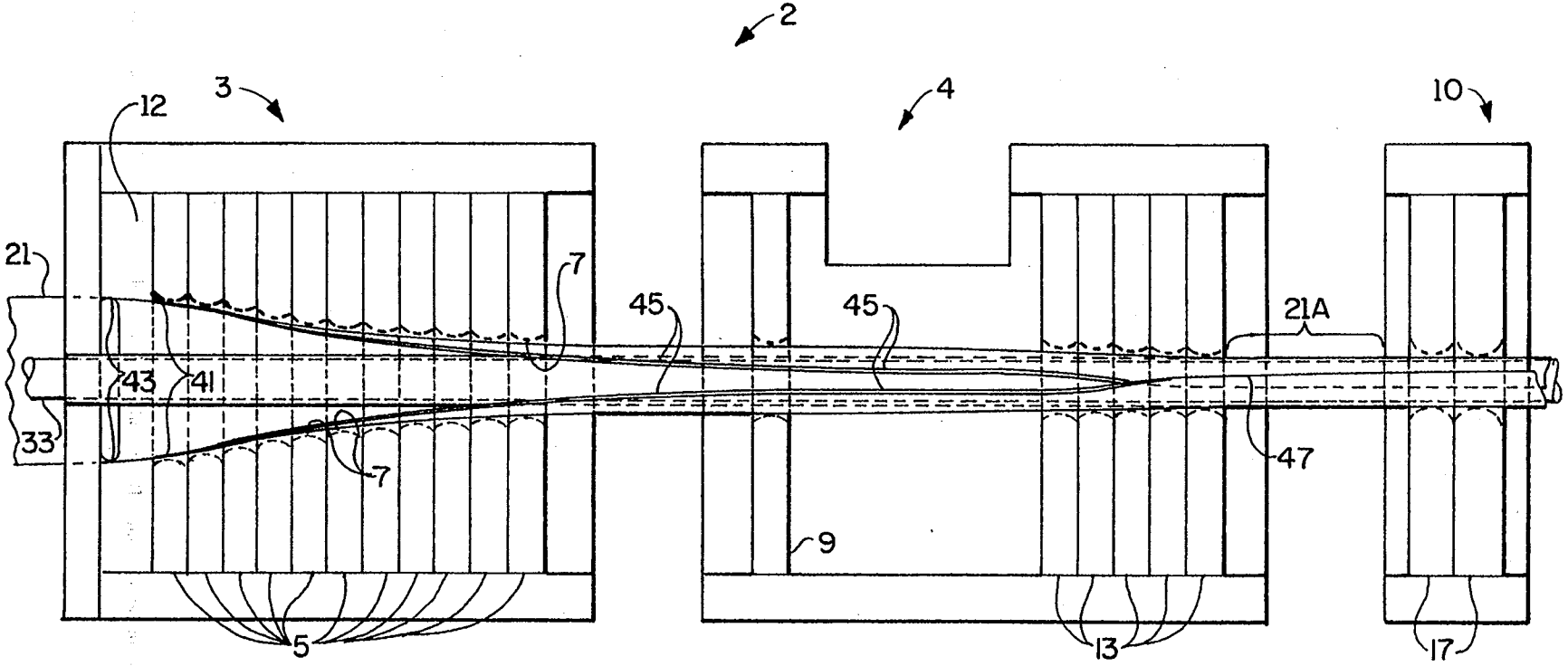
FIG. 2 is the same view of the apparatus in accordance with the present invention as shown in FIG. 1, but also showing the metal tape.

With reference to FIGS. 1 and 2 of the drawings, generally illustrated is apparatus 2 of the invention. The apparatus 2 generally has three sections, a cone former 3, an overlap former 4, and a finish former 10, which are illustrated as being spaced apart from each other. Such spacing apart is preferred but not necessary.

A cable core 33 is disposed inside the apparatus 2. It is noted that commonly manufactured communications cable core 33 is illustrated as one conductor for simplicity, although generally a plurality of conductors are bundled or stranded together. Since generally one conductor is not used, but rather a plurality of conductors are used to form the cable core 33, the core may be enclosed or wrapped with a plastic tape or binder (not shown) to hold the plurality of conductors together. Typical conductors include, but are not limited to, electrical insulated conductors or optical conductors.

Also, as is well known in the art, the cable core conductors may have a gel (not shown), such as petroleum, forced into the interstices between the conductors and about the outer surface thereof prior to wrapping with the plastic tape or binder, if present, or prior to extruding with the plastic sheath. However, it should be understood that the cable core may be unfilled with any gel.

A long flat metal tape 21, typically, but not necessarily, coated with a plastic laminate, is formed by the apparatus 2 into a cylindrical metal tube that is a shield or guard 21A about the cable core 33. Typical metals are aluminum or stainless steel. Typical widths of metal tape 21 suitable for most applications will vary from about 0.62 inch to about 1.6 inches. Also, typical sizes are given below for the various apertures of the apparatus of the invention, but it is understood that these will vary depending on the widths of metal tape 21 employed.

For simplicity, the drawings show one metal guard 21A. However, it is noted that two metal guards are common in the prior art, and the present invention also is intended to contemplate two metal guards. Thus, while not shown in the drawings, it should be understood that after a first metal guard is formed about the cable core 33 with the apparatus 2 of the present invention, the resultant may be passed through a second duplicate apparatus to form a second metal guard thereabout. Alternatively, a prior art apparatus could be used to form one guard of the first metal guard or of the second method guard, and the apparatus of the present invention used to form the other guard.

Also, while not shown in the drawings, it is to be understood that generally the metal is corrugated for ease of bending the final product of cable core encircled by a cylindrical metal guard or guards.

Also not shown in the drawings, it is typical in the art that either before or after the metal guard is formed about the cable core, a plastic protective coating is extruded over the outside of the metal. Thus, the present invention also is intended to contemplate such plastic coatings.

Referring now to FIGS. 1 and 2 of the drawings with more particularity, the first section of the apparatus 2 of the invention is the cone former 3. Disposed at the entrance thereof is a break ring 12, followed by adjacent cone rings 5. The break ring 12 has an aperture 31, which breaks the metal tape 21 as the metal tape enters and moves in the longitudinal direction through the aperture 31 of the break ring 12, whereby the metal tape, which was in the form of a flat tape, starts to bend in the transverse direction into a U-shape with the cable core 33 therein. The cable core 33 should have its longitudinal axis disposed approximately at the longitudinal axis 25 of the cone former 3.

As better illustrated in FIG. 2, the metal tape 21 advances in the longitudinal direction through the break ring 12, which starts the metal tape 21 bending in the transverse direction. It is noted that it is not shown in the drawings, but there may be more than one break ring 12. As the metal tape 21 is entering and moving through the break ring 12, the two edges 41 of the metal tape 21 break at about locations 43, i.e. the entrance to aperture 31, and come closer together forming a U-shape.

Other breaking means, in lieu of the just-described break ring 12, may be employed to start the metal tape 21 bending. For instance, there may be employed the prior art cone, illustrated by surface 87 in FIG. 5 of the above-mentioned U.S. Pat. No. 4,308,662. Also as illustrated in this patent, the cone may have a plurality of flat quadrilateral surfaces, as opposed to a continuously curved surface.

Once the metal tape 21 breaks and begins to bend, it then passes through the cone rings 5 of the cone former 3. Each cone ring has a forming aperture 7, and the cone rings 5 are arranged so that the forming apertures 7 thereof are adjacent and are of sequentially decreasing diameter when proceeding from the entrance end of the cone former 3 to the exit end thereof.

It is preferred that the diameter of the break ring aperture 31 and also the outside diameter of the break ring 12 be substantially the same as the diameter of the second cone ring forming aperture 7 and the outside diameter of the second cone ring 5, respectively. Thus, the first cone ring 5 should have an outside diameter larger than that of the break ring 12 and that of the second cone ring 5. Likewise the first cone ring 5 should have a larger diameter for its forming aperture 7 than that of the break ring aperture 31 and that of the second cone ring forming aperture 7. The purpose is to help prevent the metal tape 21 from jamming against the second cone ring 5.

The adjacent cone rings 5 and the forming apertures 1 thereof are generally of the same size as the overlap rings 13 and the apertures 15 thereof, which are further described below.

The generally circular forming apertures 7 of the cone rings 5, as they sequentially decrease, bring the edges 41 of the metal tape 21 closer together into a U-shape. When the metal tape 21 reaches location 45, the metal tape 21 is generally formed into a C-shape as it exits the cone former 3. Thus, the two edges 41 approach becoming adjacent.

Disposed inside the break ring 12, preferably is a core tube 8 of generally cylindrical shape to assist the metal tape 21 as it breaks so that it bends towards a U-shape and then a C-shape so that eventually it will form a circular shape about the cable core 33. In other words, the metal tape 21 is disposed between the break ring 12 and the core tube 8, with the cable core 33 disposed inside the core tube 8. The core tube 8 proceeds from the entrance of the break ring 12 to the exit of the last cone ring 5.

Not shown in the drawings, the cone former 3 is attached by a bracket or other holding device, as is well known in the art, to a wall, table, or the like, to keep the cone former 3 in place during use.

Next, the now C-shaped metal tape 21 with the cable core 33 disposed therein enters and moves through the second section of the apparatus of the invention, which is the overlap former 4. Disposed at the beginning entrance of the overlap former 4 is a guider ring 9, which is followed by adjacent overlap rings 13. The guider ring 9 has an aperture 11 therein of generally circular shape, except that guider aperture 11 contains a notch 6 for guiding the two edges 41 of the metal tape.

Notch 6 is of generally U-shaped configuration, so that each longitudinal edge 41 of the metal tape 21 is placed on each side 6A of the U-shaped notch 6. The purpose of the guider ring 9 and its notched guider aperture 11 is to keep the two longitudinal edges 41 of the metal tape 21 aligned in the same position and thereby prevent rotating. This keeps the edges 41 in the same alignment as the metal tape 21 passes through the overlap rings 13 so that the overlap rings 13 can engage the metal tape 21. Preferably, the depth of each of the two notch sides 6A varies from about 6% to about 20% of the total diameter (the diameter including the depth 6A) of the guider aperture 11, but must generally be greater than the tape thickness.

For instance, a notch is formed by a machinist first tooling an aperture of 0.4 inch, for example, in a guider ring, and then calling out the diameter of the aperture by 0.04 inch. Then, the machinist will blend in the circumference of the aperture till the radius of the aperture is 0.22 inch so that the total diameter is to 0.44 inch. In this example, since the total diameter length of the guider aperture would be 0.44 inch, the notch depth would be about 10% of the total diameter length.

It is preferred that the diameter of the aperture 11 of the guider ring 9 be the same as the diameter of the overlap aperture 15 of the first overlap ring 13, as this feature assists in keeping the two edges 41 of the metal tape 21 aligned properly so that they can be overlapped by the overlap rings 13. The overlap rings 13 are arranged so that the overlap apertures 15 thereof are adjacent and of sequentially diminishing diameter proceeding in the direction towards the exit of the overlap former 4. The overlap aperture 15 of each overlap ring 13 is of a generally circular cross-section having a step 27, whereby the diameter of the overlap aperture 15 increases in the last quadrant thereof. The final cylindrical shape with generally circular cross-section of the metal tape 21 is developed by the steps 27 in the overlap apertures 15 of the overlap rings 13.

One edge 41 of the metal tape 21 engages the step 27 as the metal tape 21 advances into the overlap aperture 15 of the first overlap ring 13, and then continues to engage the other steps 27 of the remaining overlap apertures 15 as the metal tape 21 continues to advance therethrough. As the metal tape 21 is advancing, the diameters of the overlap apertures 15 become smaller and smaller, which causes one edge 41 to be an overlapping edge and the other edge 41 to be an underlapping edge. The two edges 41 are substantially continuously engaged at about location 47 when the metal tape 21, which is now in the form of a cylinder 21A, comes out of the exit end of the overlap former 4.

Typical average diameters of the overlap apertures 15 of the overlap rings 13 will vary from about 0.03 inch to about 1.24 inches, more preferably about 0.2 inch to about 0.6 inch. The length of the step 27 of an overlap aperture 15 of an overlap ring 13 should preferably be from about 6% to about 20% of the greatest diameter (the diameter length including the length of the step 27).

For instance, a step is formed by a machinist first tooling an aperture of 0.3 inch, for example, in an overlap ring, and then calling out the diameter of the aperture by 0.04 inch. Then, the machinist will blend in the circumference of the aperture till the radius of the aperture is back to 0.15 inch (i.e., half the original diameter of 0.3 inch) so that the diameter is blended back to 0.3 inch. In this example, the smallest diameter of the aperture would be 0.30 inch, the greatest diameter of the aperture would be 0.34 inch, and the length of the step would be about 13.3% of the greatest diameter.

Not shown in the drawings, overlap former 4 has a bracket or other holding means, as is well known in the art, to attach the overlap former 4 to a table, wall, or the like, to hold it in position during use.

The now cylindrically configured metal tape 21A, which has exited the overlap former 4, enters the third section of the apparatus of the invention, namely the finish former 10. Disposed inside finish former 10 are two adjacent finish rings 17. Each of the finish rings 17 has a small diameter aperture 19 of generally circular cross-section. The finish rings 17 are arranged so that the small diameter apertures 19 thereof are adjacent and are of sequentially decreasing diameter when proceeding from the entrance end of the finish former 10 to the exit end thereof. In other words, the small diameter aperture 19 of the first finish ring 17 at the entrance of the finish former 10 is larger than the small diameter aperture 19 of the second finish ring 17 at the exit of the finish former 10.

The purpose of the finish rings 17 is final sizing of the metal tape, which now has its edges 41 overlapped and continuously engaged so that its shape is a generally cylindrical tube with a generally circular cross-section. Each of the finish rings 17 has a small diameter aperture 19 of generally circular cross-section, which forces or depresses the overlapped metal edge down onto the underlapped metal edge to maintain substantially continuous engagement of the overlapped edge with the underlapped edge as a longitudinal overlapped seam, whereby the metal tape maintains its final cylindrical shape with generally circular cross-section. Although not necessary, it is desirable to have the outside diameter of the finish rings 17 be greater than the outside diameter of the cone rings 5 to avoid confusion there-with when initially setting up the apparatus or when putting in replacements for worn out rings.

Not shown in the drawings, finish former 10 has a bracket or other holding means, as is well known in the art, to attach it to a wall, table, or the like, so that it stays in position during use.

To understand better the shape of the aperture of each of the rings, shown in FIGS. 3A, 3B, 3C, 3D, and 3E is a cross-sectional end view of each of the rings. As noted above, the same numbering has been used for the same parts in the different Figures for purposes of clarity.

Figure 3E:
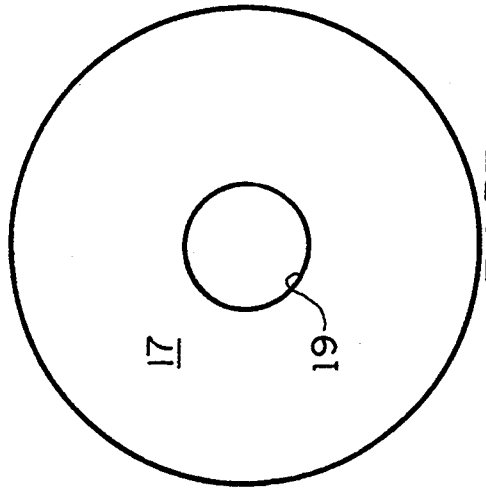
FIGS. 3A, 3B, 3C, 3D, and 3E are cross-sectional end views of the different rings of the apparatus in accordance with the present invention as shown in cross-sectional side view in FIG. 1.
Figure 3C:
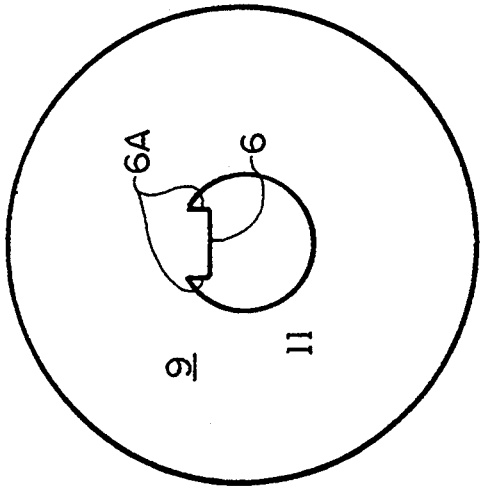
Figure 3D:
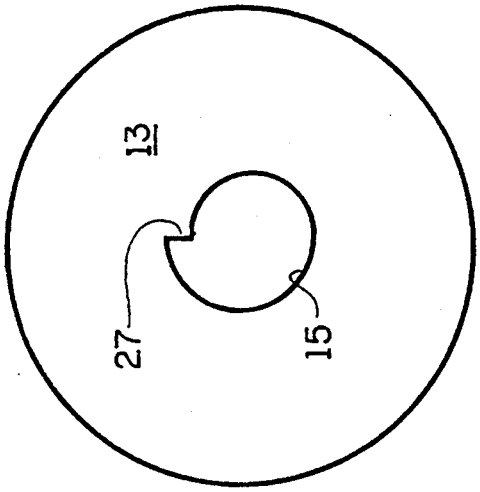
Figure 3B:
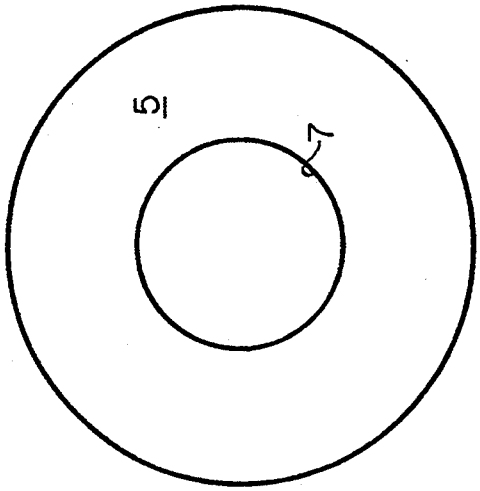
Figure 3A:
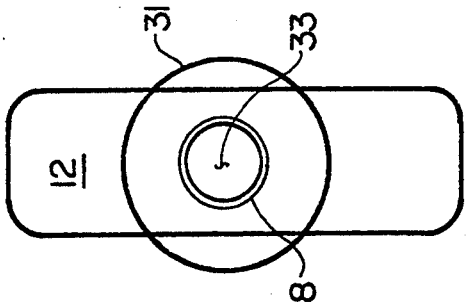

More particularly, first shown in FIG. 3A is a cross-sectional end view of a break ring 12 and its aperture 31, inside of which is the guiding core tube 8, inside of which is the cable core 33. As can be seen, aperture 31 is of generally circular cross-section.

Next in FIG. 3B is shown a cross-sectional end view of a cone ring 5 and its forming aperture 7. As can be seen, forming aperture 7 is of generally circular cross-section.

Next in FIG. 3C is shown a cross-sectional end view of the guider ring 9 and its aperture 11. As can be seen, aperture 11 is of generally circular cross-section, but one quadrant thereof has notch 6, which is generally U-shaped. The U-shaped notch 6 has first and second sides 6A. As mentioned above, one edge 41 of the metal tape 21 will engage one side 6A of the U-shaped notch 6 while the other edge 41 of the metal tape 21 will engage the other side 6A of the U-shaped notch 6, whereby the longitudinal edges 41 are approaching becoming adjacent each other and adapted to be received by the overlap rings 13.

Next in FIG. 3D is shown a cross-sectional end view of an overlap ring 13 with its overlap aperture 15. As can be seen, overlap aperture 15 is of generally circular cross-section, but with a step 27 providing an increasing diameter within the last quadrant of overlap aperture 15.

Last in FIG. 3E is shown a cross-sectional end view of a finish ring 17 and its aperture 19. As can be seen, aperture 19 is of generally circular cross-section.

It is noted that the rings may be rotated. Therefore, the seam from the two joined overlapped edges 41 may be on the side of the metal tape 21 during formation thereof, as is shown in FIG. 2, or the seam may be at the top of the metal tape 21 during formation. Any other desired position could also be accomplished through rotation.

Also, it is noted that the invention has been described so that the finish rings 17 press the overlapped edge 41 and the underlapped edge 41 together in a tight substantially continuous engagement. This pressing together is intended such that the two edges maintain engagement with each other when the end product is bent during use thereof whereby the edges do not penetrate the subsequently extruded plastic coating or the cable core. It should be understood that typically the engagement is sufficient so that a lock seam is formed.

Also, while the invention has been described as providing a metal guard or shield for a cable core 33, it should be apparent that the invention could be used in the forming of a metal covering guard over any elongated member, as well as in the forming of a metallic tape into a cylindrical tube absent having anything, such as a cable core, disposed therein. In the event of the latter, the core guide 8 could be removed.

It will be understood that various details of the invention may be changed without departing from the scope of the invention. Furthermore, the foregoing description is for the purpose of illustration only, and not for the purpose of limitation—the invention being defined by the claims.

What is claimed is:

1. A method of forming a metallic tape into a substantially cylindrical configuration having a longitudinal overlapped seam, said method comprising the steps of:

moving successive increments of a generally flat metallic tape into engagement with a breaking means to cause the successive increments to have at least a partially curved configuration, the metallic tape having two longitudinal edges whereby via the curved configuration the longitudinal edges of the successive increments approach becoming adjacent each other;

moving the successive increments having the at least partially curved configuration through a plurality of adjacent forming apertures, said forming apertures being of a generally circular cross-section and having sequentially decreasing diameters, to cause the metallic tape to have a generally U-shaped configuration and then a generally C-shaped configuration that is approaching a generally circular configuration as the two longitudinal edges become increasingly adjacent each other;

moving the successive increments through a guider aperture, said guider aperture being of generally circular cross-section having a U-shaped notch in one quadrant thereof, said U-shaped notch having a first side and a second side, whereby one longitudinal edge of the metallic tape engages the first side of the U-shaped notch and the other longitudinal edge of the metallic tape engages the second side of the U-shaped notch, thereby maintaining the metallic tape in alignment;

moving the successive increments of the aligned metallic tape through a plurality of adjacent overlap apertures, said overlap apertures being of sequentially decreasing diameter, and each of said overlap apertures being of a generally circular cross-section having a step in one quadrant thereof, whereby the diameter of each overlap aperture increases in that quadrant so that one longitudinal edge of the metallic tape engages the step, whereby as the successive increments of the metallic tape pass through the overlap apertures, the longitudinal edge of the metallic tape in engagement with the step becomes an overlapping longitudinal edge which overlaps the other underlapping longitudinal edge of the metallic tape;

directing the overlapping longitudinal edge into substantially continuous engagement with the underlapping longitudinal edge to cause the metallic tape to become a generally cylindrical tube of generally circular cross-section, with the overlap apertures performing only on the side of the metallic tape that becomes the outside of the generally cylindrical tube; and then moving successive increments of the cylindrical tube through two adjacent finish apertures of generally circular cross-section, said finish apertures being of sequentially decreasing diameter, the finish apertures forcing the overlapped edge onto the underlapped edge on the side of the metallic tape that becomes the outside of the generally cylindrical tube in order to maintain the engagement thereof as a longitudinal overlapped seam.

2. The method of claim 1, wherein the breaking means is a break ring or a cone.

3. The method of claim 2, wherein the breaking means is a break ring having an aperture of substantially the same diameter as the aperture of the second forming aperture of the plurality of adjacent forming apertures.

4. The method of claim 1, wherein the adjacent forming apertures are the apertures of cone rings.

5. The method of claim 1, wherein the overlap apertures are the apertures of overlap rings.

6. The method of claim 1, wherein the notched guider aperture is the aperture of a guider ring.

7. The method of claim 6, wherein the guider aperture in the guider ring has substantially the same diameter as the second overlap aperture of the plurality of overlap apertures.

8. The method of claim 1, wherein the finish apertures are the apertures of finish rings.

9. The method of claim 1, wherein the metallic tape is corrugated.

10. An apparatus for forming a generally flat metallic tape into a substantially cylindrical configuration having a longitudinal overlapped seam, said apparatus comprising:

a breaking means which will, when engaged with moving successive increments of a generally flat metallic tape, cause the successive increments to have at least a partially curved configuration, the metallic tape having two longitudinal edges whereby via the curved configuration the longitudinal edges of the successive increments approach becoming adjacent each other;

a plurality of adjacent forming apertures, said forming apertures being of a generally circular cross-section and having sequentially decreasing diameters, which forming apertures will, when the successive increments having the at least partially curved configuration are moved therethrough, cause the metallic tape to have a generally U-shaped configuration and then a generally C-shaped configuration that is approaching a generally circular configuration as the two longitudinal edges become increasingly adjacent each other;

a guider aperture, said guider aperture being of a generally circular cross-section having a U-shaped notch in one quadrant thereof, said U-shaped notch having a first side and a second side, which guider aperture will, when the successive increments are moved therethrough, engage one longitudinal edge of the metallic tape with the first side of the U-shaped notch and the other longitudinal edge of the metallic tape with the second side of the U-shaped notch, thereby maintaining the metallic tape in alignment;

a plurality of adjacent overlap apertures, said overlap apertures being of sequentially decreasing diameter, and each of said overlap apertures being of a generally circular cross-section having a step in one quadrant thereof, whereby the diameter of each overlap aperture increases in that quadrant, and which overlap apertures will, when the successive increments of the metallic tape pass therethrough, engage one longitudinal edge of the metallic tape with the steps of the apertures only on the side of the metallic tape that becomes the outside of a generally cylindrical tube of generally circular cross-section, whereby the one longitudinal edge becomes an overlapping longitudinal edge which overlaps the other underlapping longitudinal edge of the metallic tape, whereby the overlapping longitudinal edge is directed into substantially continuous engagement with the underlapping longitudinal edge to cause the metallic tape to become the generally cylindrical tube of generally circular cross-section; and two adjacent finish apertures of generally circular cross-section, said finish apertures being of sequentially decreasing diameter, which finish apertures will, when successive increments of the cylindrical tube pass therethrough, force the overlapping edge onto the underlapping edge on the side of the metallic tape that becomes the outside of the generally cylindrical tube in order to maintain the engagement thereof as a longitudinal overlapped seam.

11. The apparatus of claim 10, wherein the breaking means is a break ring or a cone.

12. The apparatus of claim 11, wherein the breaking means is a break ring having an aperture of substantially the same diameter as the aperture of the second forming aperture of the plurality of adjacent forming apertures.

13. The apparatus of claim 12, wherein the adjacent forming apertures are the apertures of cone rings.

14. The apparatus of claim 10, wherein the notched guider aperture is the aperture of a guider ring.

15. The apparatus of claim 14, wherein the guider aperture in the guider ring has substantially the same diameter as the second overlap aperture of the plurality of overlap apertures.

16. The apparatus of claim 10, wherein the overlap apertures are the apertures of overlap rings.

17. The apparatus of claim 10, wherein the finish apertures are apertures of finish rings.

* * * * *